US005240897A

United States Patent [19]

Braun et al.

[11] Patent Number: 5,240,897

[45] Date of Patent: * Aug. 31, 1993

[54] HEAT-SENSITIVE RECORDING MATERIAL

[75] Inventors: Rosalinde Braun, Riehen; Rudolf Zink, Therwil, both of Switzerland

[73] Assignee: Ciba-Geigy Corporation, Ardsley, N.Y.

[ * ] Notice: The portion of the term of this patent subsequent to May 7, 2008 has been disclaimed.

[21] Appl. No.: 612,751

[22] Filed: Nov. 13, 1990

[30] Foreign Application Priority Data

Nov. 21, 1989 [CH] Switzerland ..... 04 169/89-7

[51] Int. Cl.[5] ..... B41M 5/30; B41M 5/32

[52] U.S. Cl. ..... 503/209; 503/212; 503/216; 503/217; 503/218; 503/220; 503/223

[58] Field of Search ..... 503/212, 216-218, 503/220, 208, 209; 427/150-152

[56] References Cited

U.S. PATENT DOCUMENTS

| | | | |
|---|---|---|---|
| 4,513,302 | 4/1985 | Braun | 503/210 |
| 5,013,707 | 5/1991 | Phaff et al. | 503/212 |
| 5,024,988 | 6/1991 | Zink et al. | 503/212 |

*Primary Examiner*—B. Hamilton Hess

*Attorney, Agent, or Firm*—George R. Dohmann; Marla J. Mathias

[57] ABSTRACT

A heat-sensitive recording material which contains (A) a polycyclic compound of the formula

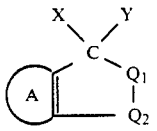

(1)

in which

X is a monocyclic or polycyclic aromatic or heteroaromatic radical,

Y is a substituent detachable as an anion, $Q_1$ is —O—, —S—, >N—R or >N—NH—R, $Q_2$ is $—CH_2—$, —CO—, —CS— or $—SO_2—$ and R is hydrogen, $C_1$-$C_{12}$alkyl, $C_5$-$C_{10}$cycloalkyl, aryl such as phenyl or aralkyl such as benzyl, and ring A is an aromatic or heterocyclic radical having 6 ring atoms, which can have an aromatic fused ring, it being possible for both ring A and the fused ring to be substituted, and (B) an organic condensable complex compound of a zinc salt.

33 Claims, No Drawings

HEAT-SENSITIVE RECORDING MATERIAL

Heat-sensitive recording materials are in general prepared by applying to the surface of a substrate such as paper a coating composition obtained by finely milling and dispersing a colourless chromogenic substance (colour former) and a colour developer as electron acceptor, mixing the resulting dispersions with one another and adding a binder, filler and other auxiliaries, for example lubricants and/or sensitizers. Upon exposure to heat, a chemical reaction of the chromogenic compound with the colour developer takes place in the coating with colour formation.

It has now been found that a heat-sensitive recording material is obtained by using, instead of the leuko dye, the starting components which are suitable for forming the desired dye, colour formation being obtained by exposure to heat and, if desired, additionally by the application of pressure.

The present invention therefore relates to a heat-sensitive recording material which contains in its colour reactant system (A) a polycyclic compound of the formula

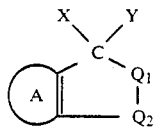

(1)

in which

X is a monocyclic or polycyclic aromatic or heteroaromatic radical,

Y is a substituent detachable as an anion, $Q_1$ is —O—, —S—, >N—R or >N—NH—R, $Q_2$ is —$CH_2$—, —CO—, —CS— or —$SO_2$— and R is hydrogen, $C_1$–$C_{12}$alkyl, $C_5$–$C_{10}$cycloalkyl, aryl, such as phenyl, or aralkyl such as benzyl, and ring A is an aromatic or heterocyclic radical having 6 ring atoms, which can have an aromatic fused ring, it being possible for both ring A and the fused ring to be substituted, and (B) an organic condensable complex compound of a zinc salt.

Components (A) and (B) make contact with one another by means of heat and, if desired, additionally by means of pressure and leave behind recorded images on the substrate. The colour produced is determined by the type of components (A)and (B). Thus, it is possible to produce the desired colours, for example yellow, orange, red, violet, blue, green, grey, black or mixed colours by a suitable combination of the individual components. A further possible combination consists in using components (A) and (B) together with one or more conventional colour formers, for example 3,3-bis-(aminophenyl)phthalides such as CVL, 3-indolyl-3-aminophenylaza- or -diazaphthalides, 3,3-bis(indolyl)phthalides, 3-aminofluorans, 6-dialkylamino-2-dibenzylaminofluorans. 6-dialkylamino-3-methyl-2-arylaminofluorans, 3,6-bisalkoxyfluorans, 3,6-bis(-diarylamino)fluorans, leukoauramines, spiropyrans, spirodipyrans, benzoxazines, chromenopyrazoles, chromenoindoles, phenoxazines, phenothiazines, quinazolines, rhodamine lactams, carbazolylmethanes or further triarylmethane leuko dyes.

The compounds of the formula (1) (component (A)) contain, as part of their structure, the basic structure, for example, of a lactone, lactam, sultone, sultam or phthalan, and these basic structures are subject to ring opening or bond cleavage upon contact with component (B), which presumably also occur in the previously customary recording materials.

In formula (1), the heteroaromatic radical X is advantageously bound to the central (meso) carbon atom of the polycyclic compound via a carbon atom of the hetero ring.

Examples of heteroaromatic radicals X are thienyl, acridinyl, benzofuranyl, benzothienyl, naphthothienyl or phenothiazinyl radicals, but advantageously pyrrolyl, indolyl, carbazolyl, julolidinyl, kairolinyl, indolinyl, dihydroquinolinyl or tetrahydroquinolinyl radicals.

The mono- or polynuclear heteroaromatic radical can be mono- or poly-substituted on the ring. Examples of suitable C substituents are halogen, hydroxyl, cyano, nitro, lower alkyl, lower alkoxy, lower alkylthio, lower alkoxycarbonyl, acyl having 1 to 8 carbon atoms, preferably lower alkylcarbonyl, amino, lower alkylamino, lower alkylcarbonylamino or di(lower)alkylamino, $C_5$–$C_6$cycloalkyl, benzyl or phenyl, while examples of N substituents comprise $C_1$–$C_{12}$alkyl, $C_2$–$C_{12}$alkenyl, $C_5$–$C_{10}$cycloalkyl, $C_1$–$C_8$acyl, phenyl, benzyl, phenethyl or phenisopropyl, each of which can be substituted, for example, by cyano, halogen, nitro, hydroxyl, lower alkyl, lower alkoxy, lower alkylamino or lower alkoxycarbonyl.

The alkyl and alkenyl radicals can be straight-chain or branched. Examples of these are methyl, ethyl, n-propyl, isopropyl, n-butyl, 1-methylbutyl, t-butyl, sec-butyl, amyl, isopentyl, n-hexyl, 2-ethylhexyl, isooctyl, n-octyl, 1,1,3,3-tetramethylbutyl, nonyl, isononyl, 3-ethylheptyl, decyl or n-dodecyl and vinyl, allyl, 2-methylallyl, 2-ethylallyl, 2-butenyl or octenyl.

Acyl is in particular formyl, lower alkylcarbonyl, for example acetyl or propionyl, or benzoyl. Further acyl radicals can be lower alkylsulfonyl, for example methylsulfonyl or ethylsulfonyl and phenylsulfonyl. Benzoyl and phenylsulfonyl can be substituted by halogen, methyl, methoxy or ethoxy.

Lower alkyl, lower alkoxy and lower alkylthio are those groups or group components which have 1 to 6, in particular 1 to 3, carbon atoms. Examples of this type of groups are methyl, ethyl, n-propyl, isopropyl, n-butyl, sec-butyl, amyl, isoamyl or hexyl and methoxy, ethoxy, isopropoxy, isobutoxy, tert-butoxy or amyloxy and methylthio, ethylthio, propylthio or butylthio.

Halogen is, for example, fluorine, bromine or preferably chlorine.

Preferred heteroaromatic radicals are substituted 2- or 3-pyrrolyl or in particular 3-indolyl radicals, for example N-$C_1$–$C_8$alkylpyrrol-2-yl, N-phenylpyrrol-3-yl, N-$C_1$–$C_8$alkyl-2-methylindol-3-yl, N-$C_2$–$C_4$alkanoyl-2-methylindol-3-yl, 2-phenylindol-3-yl or N-$C_1$–$C_8$alkyl-2-phenylindol-3-yl radicals.

An aromatic radical X can be a phenyl or naphthyl radical which is unsubstituted or substituted by halogen, cyano, lower alkyl, $C_5$–$C_6$cycloalkyl, $C_1$–$C_8$acyl, —$NR_1R_2$, —$OR_3$ or —$SR_3$.

An aromatic radical X is preferably a substituted phenyl radical of the formula

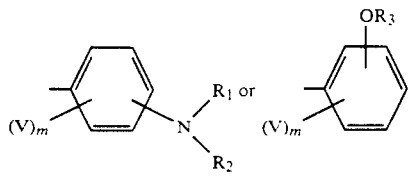

(1a) (1b)

In this formula, $R_1$, $R_2$ and $R_3$, independently of one another, are each hydrogen, unsubstituted or halogen-, hydroxyl-, cyano- or lower alkoxy-substituted alkyl having a maximum number of 12 carbon atoms, acyl having 1 to 8 carbon atoms, cycloalkyl having 5 to 10 carbon atoms or phenalkyl or phenyl which is unsubstituted or ring-substituted by halogen, trifluoromethyl, cyano, lower alkyl, lower alkoxy, lower alkoxycarbonyl, —NX'X" or 4—NX'X"-phenylamino, in which X' and X", independently of one another, are hydrogen, lower alkyl, cyclohexyl, benzyl or phenyl, or $R_1$ and $R_2$ together with the nitrogen atom linking them form a five- or six-membered, preferably saturated, heterocyclic radical. V is hydrogen, halogen, lower alkyl, $C_1$–$C_{12}$alkoxy, $C_1$–$C_{12}$acyloxy, benzyl, phenyl, benzyloxy, phenyloxy, halogen-, cyano-, lower alkyl- or lower alkoxy-substituted benzyl or benzyloxy, or is the group —$NT_1T_2$. $T_1$ and $T_2$, independently of one another, are each hydrogen, lower alkyl, $C_5$–$C_{10}$cycloalkyl, unsubstituted or halogen-, cyano-, lower alkyl- or lower alkoxy-substituted benzyl, or acyl having 1 to 8 carbon atoms and $T_1$ is also unsubstituted or halogen-, cyano-, lower alkyl- or lower alkoxy-substituted phenyl. m is 1 or 2. —$NR_1R_2$ and —$OR_3$ are preferably in the para-position relative to the linkage point. One V is preferably in the ortho-position relative to the linking point.

R, $R_1$, $R_2$ and $R_3$ as alkyl are, for example, the substituents listed above for alkyl radicals.

Substituted alkyl radicals in $R_1$, $R_2$ and $R_3$, are in particular cyanoalkyl, halogenoalkyl, hydroxyalkyl, alkoxyalkyl each preferably having a total of 2 to 8 carbon atoms, for example 2-cyanoethyl, 2-chloroethyl, 2-hydroxyethyl, 2-methoxyethyl, 2-ethoxyethyl, 2,3-dihydroxypropyl, 2-hydroxy-3-chloropropyl, 3-methoxypropyl, 4-methoxybutyl or 4-propoxybutyl.

Examples of R, $R_1$, $R_2$, $R_3$, $T_1$ and $T_2$ as cycloalkyl are cyclopentyl, cycloheptyl or preferably cyclohexyl. The cycloalkyl radicals can contain one or several $C_1$–$C_4$alkyl radicals, preferably methyl groups, and have a total of 5 to 10 carbon atoms. R, $R_1$, $R_2$ and $R_3$ as aralkyl or phenalkyl can be phenethyl, phenylisopropyl or in particular benzyl.

Preferred substituents in the phenalkyl and phenyl group of the R radicals are, for example, halogen, cyano, methyl, trifluoromethyl, methoxy or carbomethoxy. Examples of these araliphatic and aromatic radicals are methylbenzyl, 2,4- or 2,5-dimethylbenzyl, chlorobenzyl, dichlorobenzyl, cyanobenzyl, tolyl, xylyl, chlorophenyl, methoxyphenyl, 2,6-dimethylphenyl, trifluoromethylphenyl or carbomethoxyphenyl.

The acyloxy radical in V is, for example, formyloxy, lower alkylcarbonyloxy, for example acetoxy or propionyloxy, or benzoyloxy. V as a $C_1$–$C_{12}$alkoxy radical can be a straight-chain or branched group, for example methoxy, ethoxy, isopropoxy, n-butoxy, tert-butoxy, amyloxy, 1,1,3,3-tetramethylbutoxy, n-hexyloxy, n-octyloxy or dodecyloxy.

A heterocyclic radical formed by the substituent pair ($R_1$ and $R_2$) together with the common nitrogen atom is, for example, pyrrolidino, piperidino, pipecolino, morpholino, thiomorpholino, piperazino, N-alkylpiperazino, for example N-methylpiperazino, N-phenylpiperazino or N-alkylimidazolino. Preferred saturated heterocyclic radicals for —$NR_1R_2$ are pyrrolidino, piperidino or morpholino.

The substituents $R_1$ and $R_2$ are preferably cyclohexyl, benzyl, phenethyl, cyano(lower alkyl), for example β-cyanoethyl or primarily lower alkyl, for example methyl or ethyl. —$NR_1R_2$ is preferably also pyrrolidinyl. $R_3$ is preferably lower alkyl or benzyl.

V can be advantageously hydrogen, halogen, lower alkyl, for example methyl, benzyloxy, $C_1$–$C_8$alkoxy, primarily lower alkoxy, for example methoxy, ethoxy, isopropoxy or tert-butoxy, or the group —$NT_1T_2$, one of the radicals $T_1$ and $T_2$ being preferably $C_1$–$C_8$acyl or lower alkyl and the other hydrogen or lower alkyl. The acyl radical is in this case in particular lower alkylcarbonyl, for example acetyl or propionyl. Preferably, V is acetylamino, dimethylamino, diethylamino, benzyloxy or in particular lower alkoxy and especially ethoxy or hydrogen.

Y substituents on the central (meso) carbon atom are easily detachable substituents which are thereby converted into an anion. these substituents can be halogen atoms, aliphatic, cycloaliphatic, araliphatic, aromatic or heterocyclic ether groups, for example alkoxy, heteroaryloxy, aryloxy, cycloalkoxy and aralkoxy, or in particular acyloxy groups, which correspond, for example, to the formula $$R'—(NH—)_{n-1}—Q'—O— \quad (1c)$$

in which R' is an organic radical, preferably unsubstituted or substituted $C_1$–$C_{22}$alkyl, aryl, cycloalkyl, aralkyl or heteroaryl, Q' is —CO— or —$SO_2$— and n is 1 or 2, preferably 1. Examples of suitable acyloxy groups are acetoxy, propionyloxy, chloroacetoxy, benzoyloxy, methylsulfonyloxy, ethylsulfonyloxy, chloroethylsulfonyloxy, trifluoromethylsulfonyloxy, 2-chloroethylsulfonylacetoxy, phenylsulfonyloxy, tolylsulfonyloxy, ethylaminocarbonyloxy or phenylaminocarbonyloxy.

Preferably, Y is an acyloxy group of the formula R"—CO—O— in which R" is lower alkyl or phenyl.

$Q_1$ is preferably an oxygen atom, while $Q_2$ is preferably —$SO_2$— or in particular —CO—. In >N—R or >N—NH—R as $Q_1$, R is preferably hydrogen, methyl or phenyl.

A six-membered aromatic ring A is preferably a benzene ring which is unsubstituted or substituted by halogen, cyano, nitro, lower alkyl, lower alkoxy, lower alkylthio, lower alkylcarbonyl, lower alkoxycarbonyl, amino, lower alkylamino, lower dialkylamino or lower alkylcarbonylamino. A 6-membered heterocyclic ring A is in particular a nitrogen-containing heterocycle of aromatic character, for example a pyridine or pyrazine ring. Ring A can also contain a fused aromatic ring, preferably a benzene ring and is thus, for example, a naphthalene, quinoline or quinoxaline ring.

Preferred 6-membered aromatic or heterocyclic radicals A comprise the 2,3-pyridino, 3,4-pyridino, 2,3-pyrazino, 2,3-quinoxalino, 1,2-naphthalino, 2,3-naphthalino or 1,2-benzo radical, which is unsubstituted or substituted by halogen, such as chlorine or bromine, nitro, lower alkyl, lower alkoxy, lower alkylthio or an amino group which is unsubstituted or substituted as defined above, the unsubstituted or chlorine-tetrasubstituted 1,2-benzo radical being particularly preferred.

Particularly important components (A) for the colour reactant system according to the invention have the formula

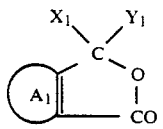

(2)

in which $A_1$ is a benzene or pyridine ring which is unsubstituted or substituted by halogen, cyano, lower alkyl, lower alkoxy or di-(lower) alkylamino, $Y_1$ is halogen, acyloxy and in particular lower alkycarbonyloxy or benzoyloxy and $X_1$ is a 3-indolyl radical of the formula

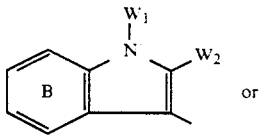

(2a)

a substituted phenyl radical of the formula

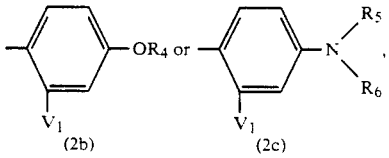

(2b) (2c)

in which $W_1$ is hydrogen, unsubstituted or cyano- or lower alkoxy-substituted $C_1$–$C_8$alkyl, acetyl, propionyl or benzyl, $W_2$ is hydrogen, lower alkyl, in particular methyl, or phenyl, $R_4$, $R_5$ and $R_6$, independently of one other, are each unsubstituted or hydroxy-, cyano- or lower alkoxy-substituted alkyl having a maximum number of 12 carbon atoms, $C_5$–$C_6$cycloalkyl, benzyl, phenethyl or phenyl, or ($R_5$ and $R_6$) together with the nitrogen atom linking them are pyrrolidino, piperidino or morpholino, $V_1$ is hydrogen, halogen, lower alkyl, $C_1$–$C_8$alkoxy, benzyloxy or the group —$NT_3T_4$, $T_3$ and $T_4$, independently of one another, are each hydrogen, lower alkyl, lower alkylcarbonyl or unsubstituted or halogen-, methyl- or methoxy-substituted benzoyl, and ring B is unsubstituted or substituted by halogen, lower alkyl, such as methyl or isopropyl or by di(lower)alkylamino such as dimethylamino.

Of the compounds of the formula (2), the lactone compounds in which $X_1$ is a 3-indolyl radical of the formula (2a) in which $W_1$ is $C_1$–$C_8$alkyl, $W_2$ is methyl or phenyl, and $Y_1$ is lower alkylcarbonyloxy, in particular acetoxy, are preferred.

Of particular interest are lactone compounds of the formula

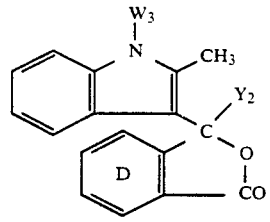

(3)

in which ring D is unsubstituted or chlorine-tetrasubstituted, $Y_2$ is acetoxy or benzoyloxy and $W_3$ is $C_1$–$C_8$alkyl, in particular ethyl, n-butyl or n-octyl.

Particular preference is also given to lactone compounds of the formula

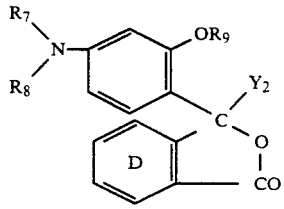

(4)

in which D and $Y_2$ are as defined in formula (3) and $R_7$, $R_8$ and $R_9$ are each lower alkyl.

Compounds of the formula (1) in which the detachable substituent Y is an acyloxy group can be prepared by reacting a keto acid or carbinol compound (lactol) of the formula

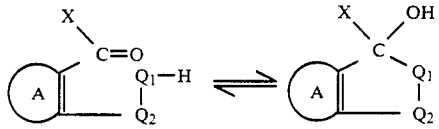

(i)

in which A, $Q_1$, $Q_2$ and X are as defined above with an acylating agent.

Suitable acylating agents are reactive functional derivatives of aliphatic, cycloaliphatic or aromatic carboxylic acids or sulfonic acids, in particular carboxylic acid halides or anhydrides, for example acetyl bromide, acetyl chloride, benzoyl chloride and especially acetic anhydride. Mixed anhydrides, that is, anhydrides of two different acids, can also be used.

Compounds of the formula (1) in which the detachable substituent Y is halogen are prepared by replacing the hydroxyl group of the carbinol compound of the formula (i) by a halogen atom by means of a halogenating agent, for example by means of thionyl chloride, phosgene, phosphorus oxychloride, phosphorus trichloride or phosphorus pentachloride in dichlorobenzene, benzene, toluene, ethylene dichloride or dimethylformamide. The halogenating agent can also be used in excess in the absence of a solvent.

By reacting compounds of the formula (1) in which Y is halogen or acyloxy with aliphatic, cycloaliphatic, araliphatic, aromatic or heterocyclic hydroxyl compounds, it is possible to introduce ether groups as further detachable substituents Y.

Compounds of the formula (1) in which the detachable substituent Y is an ether group can also be obtained by etherification of the compounds of the formula (i) with an alkylating agent or aralkylating agent.

Suitable alkylating agents are alkyl halides, for example methyl or ethyl iodide, ethyl chloride or dialkyl sulfates, such as dimethyl sulfate or diethyl sulfate. Suitable aralkylating agents are in particular benzyl chloride or the corresponding substitution products, for example 4-chlorobenzyl chloride, which are preferably used in a nonpolar organic solvent, for example benzene, toluene or xylene.

Specific examples for the compounds of the formulae (1) to (4), such as are mentioned, inter alia, in J. Am. Chem. Soc. 38 (1916) 2101–2119 and Helvetica Chimica Acta 42 (1959) 1085–1100, include 3-(4'-diethylamino-2'-ethoxyphenyl)-3-acetoxyphthalide,
3-(4'-diethylaminophenyl)-3-acetoxyphthalide,
3-(1'-ethyl-2'-methylindol-3'-yl)-3-acetoxyphthalide,
3-(4'-dimethylaminophenyl)-3-acetoxy-6-dimethylaminophthalide,
3-(1'-n-octyl-2'-methylindol-3'-yl)-3-acetoxyphthalide,
3-(1'-ethyl-2'-methylindol-3'-yl)-3-acetoxy-4,5,6,7-tetrachlorophthalide,
3-(1'-ethyl-2'-methylindol-3'-yl)-3-acetoxy-5,6-dichlorophthalide,
3-(1'-n-octyl-2'-methylindol-3'-yl)-3-acetoxy-4,5,6,7-tetrachlorophthalide,
3-(1'-n-octyl-2'-methylindol-3'-yl)-3-acetoxy-5,6-dichlorophthalide,
3-(1'-n-octyl-2'-methylindol-3'-yl)-3-acetoxy-5-methylphthalide,
3-(1'-ethyl-2'-methylindol-3'-yl)-3-acetoxy-4-azaphthalide,
3-(1'-n-octyl-2'-methylindol-3'-yl)-3-acetoxy-4-azaphthalide,
3-(1'-ethyl-2'-methylindol-3'-yl)-3-propionyloxy-4,5,6,7-tetrachlorophthalide,
3-(1'-ethyl-2'-methylindol-3'-yl)-3-benzoyloxy-4,5,6,7-tetrachlorophthalide,
3-(1'-methyl-2'-phenylindol-3'-yl)-3-acetoxy-4,5,6,7-tetrachlorophthalide,
3-(1'-n-octyl-2'-methylindol-3'-yl)-3-acetoxy-7-azaphthalide,
3-(4'-diethylamino-2'-acetoxyphenyl)-3-acetoxy-4,5,6,7-tetrachlorophthalide,
3-(4'-N-cyclohexyl-N-methylamino-2'-ethoxyphenyl)-3-acetoxyphthalide,
3-(4'-N-cyclohexyl-N-methylamino-2'-methoxyphenyl)-3-acetoxy-4-azaphthalide,
3-(4'-N-ethyl-N-p-toluidino-2'-methoxyphenyl)-3-acetoxyphthalide,
3-(4'-N-ethyl-N-isoamylamino-2'-methoxyphenyl)-3-acetoxyphthalide,
3-(4'-pyrrolidino-2'-methoxyphenyl)-3-acetoxyphthalide,
3-(4'-diethylamino-2'-ethoxyphenyl)-3-acetoxy-4-azaphthalide,
3-(4'-dimethylamino-5'-methylphenyl)-3-acetoxyphthalide,
3-(4'-diethylamino-5'-methylphenyl)-3-acetoxyphthalide,
3-(2'-acetoxy-4'-dimethylamino-5'-methylphenyl)-3-acetoxyphthalide,
3-(4'-di-n-butylamino-2'-n-butoxyphenyl)-3-acetoxyphthalide,
3-(4'-di-n-butylamino-2'-ethoxyphenyl)-3-acetoxyphthalide,
3-(4'-diethylamino-2'-n-propoxyphenyl)-3-acetoxyphthalide,
3-(3'-methoxyphenyl)-3-acetoxy-6-dimethylaminophthalide,
3-(4'-diethylamino-2'-ethoxyphenyl)-3-acetoxy-4,5,6,7-tetrachlorophthalide,
3-(4'-di-n-butylamino-2'-ethoxyphenyl)-3-acetoxy-4,5,6,7-tetrachlorophthalide,
3-(4'-diethylamino-2'-acetoxyphenyl)-3-acetoxyphthalide,
3-(4'-diethylamino-5'-methyl-2'-acetoxyphenyl)-3-acetoxy-4,5,6,7-tetrachlorophthalide,
3-(4'-di-n-butylaminophenyl)-3-acetoxyphthalide,
3-(4'-dimethylaminophenyl)-3-acetoxy-6-chlorophthalide,
3-(4'-di-2''-cyclohexylethylaminophenyl)-3-acetoxyphthalide,
3-(julolidin-6'-yl)-3-acetoxyphthalide,
3-kairolinyl-3-acetoxyphthalide,
3-(2',4'-bis-dimethylaminophenyl)-3-acetoxyphthalide,
3-(2'-acetylamino-4'-dimethylaminophenyl)-3-acetoxyphthalide,
3-(N-ethyl-carbazol-(3')-yl)-3-acetoxyphthalide,
3-(1'-ethyl-2'-methylindol-(3')-yl)-3-chlorophthalide,
3-(4'-diethylamino-2'-ethoxyphenyl)-3-chlorophthalide,
3-(4'-dimethylaminophenyl)-3-methoxy-6-dimethylaminophthalide,
3-(1'-ethyl-2'-methylindol-(3')-yl)-3-methoxy-4,5,6,7-tetrachlorophthalide,
3-(1'-ethyl-2'-methylindol-3'-yl)-3-benzyloxy-4,5,6,7-tetrachlorophthalide,
3-(2'-methylindol-3'-yl)-3-methoxyphthalide,
3-(1'-n-butyl-2'-methyl-indol-3'-yl)-3-methoxyphthalide,
3-(2'-acetoxy-5'-bromophenyl)-3-acetoxyphthalide,
3-(3'-diacetylamino-4'-methyl)-3-acetoxyphthalide,
3-(4'-chlorophenyl)-3-chlorophthalide.

The organic zinc complex compounds used as component (B) preferably have the formula

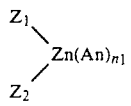

in which An is the anion of an inorganic acid, $n_1$ is 1 or 2, $Z_1$ and $Z_2$, independently of one another, are each a colourless organic ligand which is bound to zinc via heteroatoms in the form of a complex. Examples of suitable heteroatoms are oxygen, sulfur, selenium, nitrogen or phosphorus.

In the complex metal compound of the formula (5) usable a component (B), the ligands $Z_1$ and $Z_2$ can be identical or different. Preferably, they are identical and are in particular mono-coordinate (unidentate) ligands.

The colourless ligand of the complex metal compounds is preferably bound to the metal atom via nitrogen atoms in the form of a complex, the metal-binding nitrogen atoms being present in mono-coordinate, two-coordinate or three-coordinate molecules and each appearing, for example, in primary, secondary or tertiary amino groups, unsubstituted or substituted imino groups, nitrilo groups, oximido groups, hydrazine groups or hydrazone groups.

Examples of suitable nitrogen-containing mono-coordinate (monofunctional) ligands are aliphatic, cycloaliphatic, aromatic, araliphatic or heterocyclic amines and secondary or tertiary, saturated or unsaturated nitrogen heterocycles, the N atoms of which are constituents of one or several rings.

Examples of aliphatic, cycloaliphatic and araliphatic nitrogen-containing ligands are:

Alkylamines having 1 to 18 carbon atoms, for example methylamine, ethylamine, n-propylamine, isopropylamine, n-butylamine, n-hexylamine, n-octylamine, isooctylamine, n-decylamine, n-dodecylamine or octadecylamine (stearylamine); cycloalkylamines such as cyclopentylamine and cyclohexyleamine; benzylamine, 4-methylbenzylamine and α- or β-phenylethylamine. β-Phenylethylamine is particularly preferred.

Examples of suitable secondary nitrogen heterocycles are pyrrolidine, piperidine, pyrazoline, pipecoline, morpholine, thiomorpholine, indoline, benzomorpholine, tetrahydroquinoline or 2,2,4-trimethyltetrahydroquinoline.

The colourless organic ligands of the metal complex compounds used according to the invention are preferably mono-coordinate aromatic amines or nitrogen heterocycles.

Examples of suitable aromatic amines are aniline, ring-substituted aniline, for example 2-, 3- or 4-methylaniline, 2,4-dimethylaniline, 2,6-dimethylaniline, 2,4,6-trimethylaniline, 2-methoxyaniline, 3-chloroaniline, 4-chloroaniline, 4-methoxyaniline, 2-methoxy-5-methylaniline (para-cresidine), 4-ethoxyaniline, aminocresol, 2-methyl-5-methoxyaniline, dichloroaniline and N-alkylated or N,N-dialkylated aniline, for example N-methylaniline, N-ethylaniline, N,N-dimethyl- or N,N-diethylaniline, furthermore diphenylamine, 2,2'-diaminodiphenylamine, 4,4'-diaminodiphenyl ether, 4,4'-diaminodiphenyl sulfide, 4,4'-diaminodiphenyl sulfone, 4,4'-diaminodiphenyl ketone or 4,4'-diaminodiphenyl alkane, for example 4,4'-diaminodiphenylmethane or -ethane and also 4,4'-diaminoazobenzene.

Preferred organic ligands are five- or six-membered nitrogen heteroycles which are unsubstituted or substituted by $C_1$–$C_{18}$alkyl, preferably $C_1$–$C_4$alkyl, $C_1$–$C_4$alkoxy, cyano, hydroxyl, vinyl, phenyl, $C_1$–$C_4$acyl or amino groups and/or fused onto benzene rings which are unsubstituted or substituted, for example, by halogen, $C_1$–$C_4$alkyl or $C_1$–$C_4$alkoxy.

Examples of ligands of this type are pyrrole, 2,4-dimethylpyrrole, pyrrolidone, imidazole, 1-methylimidazole, 2-methylimidazole, 1-vinylimidazole, 2-phenylimidazole, pyrazole, 3,4-dimethyl-5-pyrazolone, triazoles, pyridine, α-,β- or γ-picolines, lutidines, collidines, parvolines, conyrines, methoxypyridines, aminopyridines, for example 3-aminopyridine, 2,3-diaminopyridine, 2,6-diaminopyridine, 4-formylpyridine, 4-cyanopyridine, pyrimidine, pyrazine, triazine, melamine, guanamines, ammeline, quinoline, 2-methylquinoline, 2-ethylquinoline, 8-(2'-aminophenylamino)-quinoline, isoquinoline, quinaldine, quinazoline, quinoxaline, phthalazine, cinnoline, indolizine, indoles, for example 2-methylindole or 2-phenylindole, benzimidazole, 2-methylbenzimidazole, 1,2-dimethylbenzimidazole, 2-stearylbenzimidazole, 2-aminobenzimidazole, benzoxazole, benzothiazole, 1-phenyl-3,5-diketopyrazolidine, 2-aminobenzothiazole, 2-mercaptobenzothiazole, benzotriazole, carbazole, acridine, phenazine, diguanamines, guanidines, bipyridyl, 2,6-(di-2-pyridyl)pyridine (terpyridyl), 2,6-bis(aminomethyl)-pyridine, phenanthridine, phenanthroline or dipyridyl ketone.

Particularly preferred complex metal compounds have aminopyridines, aminopicolines, antipyrine, imidazoles, benzimidazoles, benzothiazoles or quinolines as colourless heterocyclic ligands $Z_1$ and $Z_2$.

$Z_1$ and $Z_2$ can also be nitrogen-containing ligands which are at least two-coordinate (bifunctional/bidentate). The metal-binding nitrogen atoms in the ligand molecule are advantageously separated from one another by two- or three-membered saturated or unsaturated chains consisting of carbon atoms or carbon and nitrogen atoms. Examples of ligands of this type are alkylenediamines, for example ethylenediamines or propylenediamines and phenylenediamines as well as dialkylenetriamines and triaminoalkanes. Examples of dialkylenetriamines are diethylenetriamine, monoethylenemonopropylenetriamine, dipropylenetriamine and N-alkylated products thereof. Examples of triaminoalkanes are α,γ-diamino-β-(aminomethyl)propane. In these ligands, the metal-binding nitrogen atoms and the carbon atoms linking them can be preferably also constituents of a heterocyclic ring or ring system. Two-coordinate nitrogen-containing ligands of this type are piperazine, imidazolidine and diazabicyclo[2.2.2]octane.

The inorganic anions An can be monovalent or divalent. Examples of inorganic anions are halides, for example chlorides, bromides, fluorides or iodides;

Radicals of sulfur-containing acids, for example hydrogen sulfate, sulfate, disulfate or aminosulfate;

Radicals of phosphorus oxo acids, for example dihydrogen phosphate, hydrogen phosphate, phosphate or metaphosphate; radicals of nitrogen oxo acids, for example nitrate;

Radicals of carbonic acid, for example bicarbonate or carbonate;

Anions of oxo acids and complex acids, for example methosulfate, ethosulfate, hexafluorosilicate, cyanate, thiocyanate, hexacyanoferrate(II), hexacyanoferrate(III), tri-and tetrachlorozincate, tri- and tetrabromozincate, stannate, borate, divanadate, tetravanadate, molybdate, tungstate, chromate, bichromate or tetrafluoroborate; and Anions of esters of phosphoric acid, such as the anion of methyl phosphate.

Preferred anions An are the halides, for example chlorides, bromides or iodides, pseudohalides, such as thiocyanates, furthermore nitrates, sulfates, phosphates or borates.

An is in particular a thiocyanate ion.

Particularly important components (B) have the formula

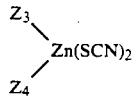

(6)

in which $Z_3$ and $Z_4$, independently of one another, are a mono-coordinate five- or six-membered nitrogen heterocycle which is bound to the metal ion via the nitrogen atom in the form of a complex and is unsubstituted or mono- or polysubstituted by cyano, vinyl, formyl, phenyl, $C_1$–$C_{18}$alkyl or in particular by methoxy, $C_1$–$C_4$alkyl, phenyl or amino groups and has a fused-on benzene ring.

$Z_3$ and $Z_4$ are preferably identical and are each primarily a pyrazolone, aminopyridine, quinoline, benzothiazole, imidazole, pyrazolinone or benzimidazole ligand bound to the nitrogen in the form of a complex, in which ligand the nitrogen hetero ring is unsubstituted or mono- or polysubstituted by methyl, methoxy, cyano, vinyl, formyl, phenyl or amino.

Particularly preferred ligands $Z_3$ and $Z_4$ are aminopyridines, quinoline, 5-pyrazolinones, 5-pyrazolones, imidazole, benzimidazole and in particular 1-methylimidazole, 2-methylimidazole, 2-aminopyridine, antipyrine, benzothiazole, anisidines and cresidines.

The preparation and individual specific examples of organic zinc complex compounds which are suitable as component (B) are described in EP-A 97,620 and also in U.S. Pat. No. 4,608,579 and U.S. Pat. No. 4,636,819. A particular suitable component (B) is the antipyrine complex of zinc thiocyanate, the 2-aminopyridine complex of zinc thiocyanate and the para-cresidine complex of zinc thiocyanate.

Not only component (A), but also in particular component (B) can additionally also be used in a mixture with pigments which are unreactive per se or little reactive or with further auxiliaries such as silica gel or UV absorbers, for example 2-(2'-hydroxyphenyl)benzotriazoles, benzophenones, cyanoacrylates, phenyl salicylates. Examples of pigments are: talc, titanium dioxide, alumina, aluminium hydroxide, zinc oxide, chalk, clays, such as kaolin, and organic pigments, for example urea/formaldehyde condensation products (BET surface area 2–75 $m^2/g$) or melamine/formaldehyde condensation products.

The mixing ratio of component (A) to components (B) depends on the type of these components, the type of colour change, the colour reaction temperature and, of course, also on the desired colour concentration. Satisfactory results are obtained by using component (B) in amounts of 0.5 to 20 parts by weight per part of component (A).

The colour formation system used according to the invention and consisting of components (A) and (B) is suitable for preparing a heat-sensitive recording material for thermography in which components (A) and (B) are brought into contact with one another upon heating and leave recordings on the support material.

As a rule, the heat-sensitive recording material contains at least one substrate, components (A) and (B) and, if desired, also a binder and/or wax. Preferably, activators, for example benzyldiphenyl, benzyloxynaphthalene, benzenesulfanilide, dibenzyl terephthalate, dimethyl terephthalate or sensitizers are also present in the recording material.

The colour-forming components (A) and (B) usable according to the invention can be used with or without colour developer (component (C)).

Inorganic or organic colour developers which are known for recording materials and are capable of withdrawing electrons (electron acceptors) can be used as component (C).

Typical examples of inorganic developers are active clay substances, such as attapulgite clay, acid clay, bentonite, montmorillonite; activated clay, for example acid-activated bentonite or montmorillonite and halloysite, kaolin, zeolite, silicon dioxide, zirconium dioxide, alumina, aluminium sulfate, aluminium phosphate or zinc nitrate.

Preferred inorganic colour developers are Lewis acids, for example aluminium chloride, aluminium bromide, zinc chloride, iron(III) chloride, tin tetrachloride, tin dichloride, tin tetrabromide, titanium tetrachloride, bismuth trichloride, tellurium dichloride or antimony pentachloride.

The organic colour developers which can be used are solid carboxylic acids, advantageously aliphatic dicarboxylic acids, for example tartaric acid, oxalic acid, maleic acid, citric acid, citraconic acid or succinic acid, and alkylphenol/acetylene resin, maleic acid/rosin resin, carboxypolymethylene or a partially or completely hydrolysed polymer of maleic anhydride with styrene, ethylene or vinyl methyl ether.

Suitable organic colour developers are in particular compounds having a phenolic hydroxyl group. These can be not only monohydric but also polyhydric phenols. These phenols can be substituted by halogen atoms, carboxyl groups, alkyl radicals, aralkyl radicals, such as α-methylbenzyl, α,α-dimethylbenzyl, aryl radicals, acyl radicals, such as arylsulfonyl, or alkoxycarbonyl radicals or aralkoxycarbonyl radicals, such as benzyloxycarbonyl.

Specific examples of phenols which are suitable as component (C) are 4-tert-butylphenol, 4-phenylphenol, methylene-bis-(p-phenylphenol), 4-hydroxydiphenyl ether, α-naphthol, β-naphthol, methyl or benzyl 4-hydroxybenzoate, methyl 2,4-dihydroxybenzoate, 4-hydroxydiphenyl sulfone, 4'-hydroxy-4-methyldiphenyl sulfone, 4'-hydroxy-4-isopropoxydiphenyl sulfone, 4-hydroxy-acetophenone, 2,4-dihydroxybenzophenone, 2,2'-dihydroxydiphenyl, 2,4-dihydroxydiphenyl sulfone, 4,4'-cyclohexylidenediphenol, 4,4'-isopropylidenediphenol, 4,4'-isopropylidene di(2-methylphenol), 4,4-bis(4-hydroxyphenyl)valeric acid, resorcinol, hydroquinone, pyrogallol, phloroglucine, p-, m-, o-hydroxybenzoic acid, 3,5-di-(α-methylbenzyl)salicylic acid, 3,5-di(α,α-dimethylbenzyl)salicylic acid, salicylosalicylic acid, alkyl gallate, gallic acid, hydroxyphthalic acid, 1-hydroxy-2-naphthoic acid or phenol/formaldehyde prepolymers, which can also be modified with zinc. Of the carboxylic acids listed, the salicylic acid derivatives are preferred and are preferably used as zinc salts. Particularly preferred zinc salicylates are described in EP-A 181,283 or DE-A 2,242,250.

The amount used of component (C), if present, depends on the type of components (A) and (B) and on the type of colour change, on the colour reaction temperature and, in certain cases, also on the desired colour concentration. Component (C) is advantageously used in amounts of 0.1 to 100 parts by weight per part of component (A) and (B) together.

Thermoreactive recording systems comprise, for example, heat-sensitive recording and copy materials and papers. These systems are used, for example for recording information, for example in electronic computers, printers, facsimile machines or copiers or in medical and technical recording and measuring instruments, for example electrocardiographs. The image formation (marking) can also take place manually by means of a heated pen. A further means for producing markings by means of heat are laser beams.

The thermoreactive recording material can also be structured in such a way that component (A) is dissolved or dispersed in a binder layer, and, in a second layer, component (B) is dissolved or dispersed in the binder. Another possibility is one in which the two components are dispersed in the same layer. The layer or layers are softened or melted in specific areas by means of heat, as a result of which components (A) and (B) make contact with one another at those points where heat has been applied, and the desired colour develops.

The thermoreactive recording material can also contain component (A) and/or (B) in encapsulated form.

Preferably, meltable, film-forming binders are used for preparing the heat-sensitive recording material. These binders are usually water-soluble, while components (A) and (B) are insoluble in water. The binder should be capable of dispersing the two components at room temperature and fixing them on the substrate.

Since paper is the preferred substrate, these binders are paper coating agents. The papers which are used are not only standard papers made of cellulose fibres but also papers in which the cellulose fibres are replaced (partially or completely) by fibres made of synthetic polymers. The substrate can also be a plastic sheet.

Water-soluble or at least water-swellable binders are, for example, hydrophilic polymers, such as polyvinyl alcohol, alkali metal polyacrylates, hydroxyethylcellulose, methylcellulose, carboxymethylcellulose, polyacrylamide, polyvinylpyrrolidone, carboxylated butadiene/styrene copolymers, gelatin, starch or esterified corn starch.

In the case where components (A) and (B) are present in two different layers, water-insoluble binders, that is, binders which are soluble in nonpolar or only weakly polar solvents, for example natural rubber, synthetic rubber, chlorinated rubber, polystyrene, styrene/-butadiene mixed polymers, polymethyl acrylates, ethylcellulose, nitrocellulose and polyvinylcarbazole can be used. However, the preferred arrangement is such that the two components are present in one layer in a water-soluble binder.

To ensure the stability of the heat-sensitive recording material or the density of the developed image, the material can be provided with an additional protective layer. This type of protective layer usually consists of water-soluble and/or water-insoluble resins which are conventional polymers or aqueous emulsions of these polymers.

Specific examples of water-soluble polymers are polyvinyl alcohol, starch, starch derivatives, cellulose derivatives, such as methoxycellulose, hydroxyethylcellulose, carboxymethylcellulose, methylcellulose or ethylcellulose, sodium polyacrylate, polyvinylpyrrolidone, polyacrylamide/acrylic ester copolymers, acrylamide/acrylic ester/methacrylic ester copolymers, alkali metal salts of styrene/maleic anhydride copolymers, alkali metal salts of isobutene/maleic anhydride copolymers, polyacrylamide, sodium alginate, gelatin, casein, water-soluble polyesters or carboxyl-modified polyvinyl alcohol.

If desired, for example, the following water-insoluble resins can be used in the protective layer in combination with the water-soluble polymer resins mentioned: polyvinyl acetate, polyurethane, styrene/butadiene copolymers, polyacrylic acid, polyacrylic ester, vinyl chloride/vinyl acetate copolymers, polybutyl methacrylate, ethylene/vinyl acetate copolymers and styrene/-butadiene/acrylic derivative copolymers.

Not only the thermoreactive layers but also the resin layers can contain further additives. To improve the whiteness or the thermal printing head suitability of the recording material and to prevent the heated pen or plate from becoming glued on, these layers can contain, for example, antioxidants, UV absorbers, solubilizers, talcum, titanium dioxide, zinc oxide, alumina, aluminium hydroxide, calcium carbonate (e.g. chalk), clays or even organic pigments, for example urea/formaldehyde polymers. To restrict the colour formation to a limited temperature range, it is possible to add substances such as urea, thiourea, diphenylthiourea, acetamide, acetanilide, benzenesulfanilide, ethylene-bis(stearamide), stearamide, phthalic anhydride, benzyl benzyloxybenzoate, metal stearates, for example zinc stearate, phthalonitrile, dimethyl terephthalate, dibenzyl terephthalate, dibenzyl isophthalate, benzyldiphenyl or other suitable meltable products which induce the simultaneous melting of the colour former components and of the developer.

Preferably, thermographic recording materials contain waxes, for example carnauba wax, montan wax, paraffin wax, polyethylene wax, condensation products of higher fatty acid amides and formaldehyde or condensation products of higher fatty acids and ethylenediamine.

To improve the applicability of the thermochromatic materials, the components (A) and (B) can be microencapsulated. For this purpose, any desired processes which are known per se for the encapsulation of colour formers or other active substances in microcapsules can be used.

In the preparation procedures and examples which follow, the percentages given are by weight unless stated otherwise. Parts are parts by weight.

Preparation procedures

Procedure A: 19.3 g of 3-(1'-ethyl-2'-methylindol-3'-yl)-3-hydroxy-4,5,6,7-tetrachlorophthalide (or the tautomer of the corresponding keto acid) are added at 25° C. with stirring to 20 ml of acetic anhydride. The mixture is heated to 117° C., this temperature is maintained for 2½ hours, and 15 ml of glacial acetic acid are added, and the resulting product is filtered off at 80° C. The residue is washed with petroleum ether

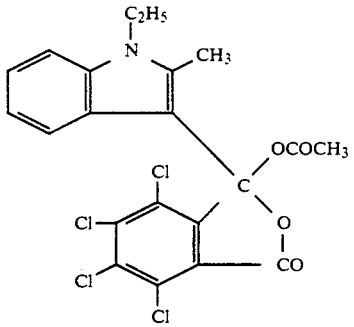

(11)

in the form of white crystals. After recrystallization from toluene/acetic anhydride, the pure product has a melting point of 187°-188° C. (decomposition).

In the IR spectrum, the acetate CO band appears at 1770 $cm^{-1}$ and the lactone CO band at 1790 $cm^{-1}$.

Procedure B: The procedure as described in A is repeated, except that 25 ml of propionic anhydride are used instead of acetic anhydride and the temperature is maintained at 110° C. for 3 hours, to give, after recrystallization from toluene, 3.8 g of the lactol ester of the formula (12)

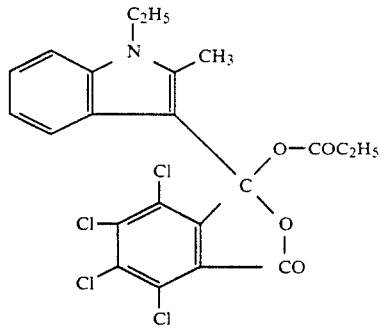

of melting point 197°–198° C.

Procedure C: 26.5 g of 3-(1'-n-octyl-2'-methylindol-3'-yl)-3-hydroxy-4,5,6,7-tetrachlorophthalide (or the tautomer of the corresponding keto acid) are heated in 30 ml of acetic anhydride to 80°–85° C. and stirred at this temperature for 3 hours. The product precipitates from the resulting solution upon cooling, after which it is filtered off. The product is washed with glacial acetic acid and petroleum ether. After recrystallization from toluene, 17.2 g of the lactol ester of the formula (13)

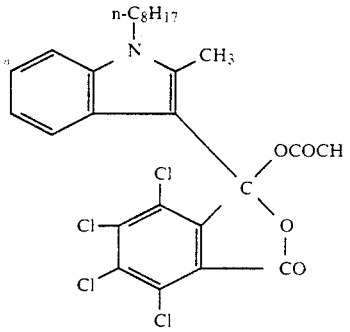

of melting point 146°–148° C. (dec.) are obtained.

Procedure D: The procedure as described in A is repeated, except that 24.6 g of 3-(1'-methyl-2'-phenylindol-3'-yl)-3-hydroxy-4,5,6,7-tetrachlorophthalide are used instead of the phthalide described there, to give, after recrystallization from toluene, 14.3 g of the lactol ester of the formula (14)

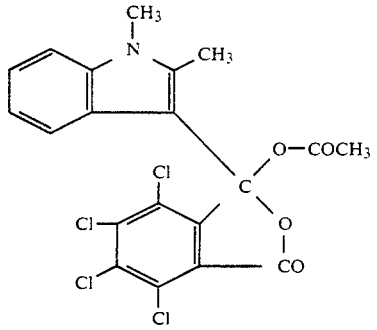

of melting point 220°–221° C. (dec.).

Procedure E: 4.5 g of 2-(2'-ethoxy-4'-diethylaminobenzoyl)-3,4,5,6-tetrachlorobenzoic acid are dissolved in 15 g of acetic anhydride at 45° C., and the mixture is maintained at 65°–70° C., for 7 hours. The product crystallizes upon cooling and is filtered off at 20° C. After drying, 3 g of a lactol ester of the formula (15)

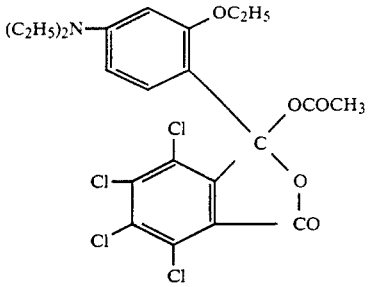

are obtained. After purification with petroleum ether, this compound has a melting point of 185°–186° C. with decomposition.

Procedure F: 4.8 g of the lactol ester of the formula (11) according to Procedure A are refluxed in 100 ml of methanol for 1 hour with stirring. After cooling, the product is filtered off to give 4 g of a phthalide compound of the formula (16)

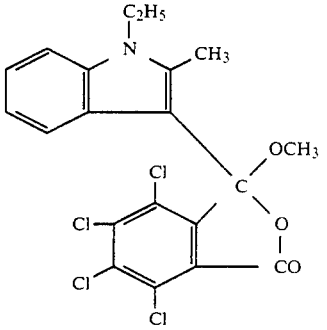

After recrystallization from toluene and methanol, the product melts at 184°–185° C.

Procedure G: The procedure as described in F is repeated, except that 50 ml of benzyl alcohol are used instead of methanol, to give a phthalide compound of the formula (17)

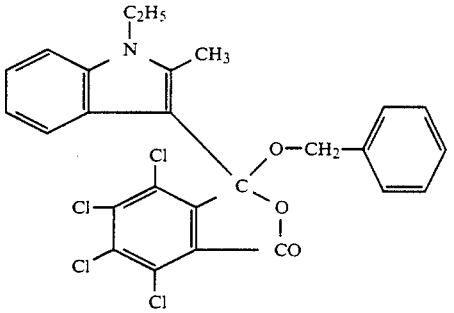

m.p. 183°–184° C.

Procedure H: The procedure as described in C is repeated, except that 30 ml of propionic anhydride are used instead of acetic anhydride, the reaction temperature is maintained at 75°–78° C. for 2½ hours, and the mixture is diluted before filtration with 10 ml of propionic anhydride, to give, after drying, 18.8 g of the lactol ester of the formula

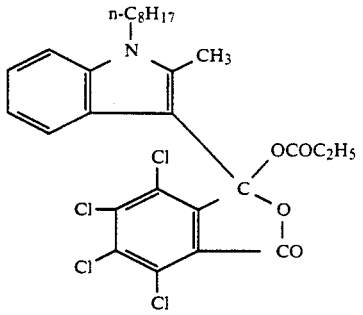

(18)

of melting point 154°-155.5° C. (dec.).

Procedure I: 36.9 g of 2-(4'-di-n-butylamino-2'-hydroxybenzoyl)benzoic acid are stirred in 240 ml of acetone and 40 ml of diethyl sulfate at 35° C. A solution of 16.8 g of potassium hydroxide in 50 ml of water is added dropwise at 35° C. (±2° C.) over a period of 4 hours, and the reaction is then completed at this temperature over a period of 20 hours. Another 11.2 g of potassium hydroxide dissolved in 50 ml of water are added, and the acetone is removed completely by azeotropic distillation up to a flask temperature of 96° C. Stirring is continued for another 2 hours at 90°-95° C. After cooling to 10° C., 18 ml of concentrated hydrochloric acid are added dropwise, resulting in the precipitation of the product. The mixture is stirred at 15°-20° C. for 16 hours, the product is filtered off and washed with water. After drying, 39.2 g of the compound of the formula

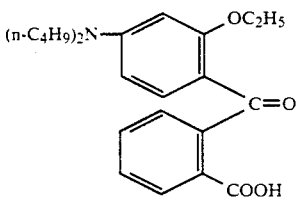

(ii)

of melting point 166°-168° C. are obtained.

11.9 g of the compound of the formula (ii) are stirred in 36 ml of acetic anhydride, the mixture is heated and maintained at 65°-70° C. for ½ an hour. The resulting solution is poured into a mixture of 150 ml of toluene and 360 ml of 15% sodium carbonate solution with vigorous stirring, the aqueous phase is separated off, the toluene phase is washed with water, dried over sodium sulfate and concentrated under reduced pressure. This gives 13 g of the compound of the formula

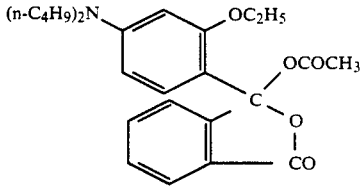

(19)

in the form of an orange-coloured oil.

Procedure K: 17 g of 2-(4'-diethylamino-2'-ethoxybenzoyl)benzoic acid are stirred in 60 ml of acetic anhydride at 65°-70° C. for 45 minutes, resulting in an orange-coloured solution. This solution is poured into a mixture of 250 ml of toluene and 600 ml of 15% sodium carbonate solution with thorough stirring. The alkaline aqueous phase is separated off, the toluene phase is washed with water, dried with sodium sulfate and evaporated to dryness. The residue is recrystallized from toluene/petroleum ether 1:1 and gives, after drying, 13.2 g of the compound of the formula

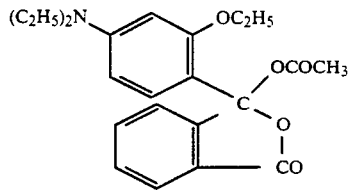

(20)

of melting point 95°-97° C. with decomposition.

Procedure L: 45.2 g of benzoic anhydride are melted at 50° C. At this temperature, 8.9 g of 3-(1'-ethyl-2'-methylindol-3'-yl)-3-hydroxy-4,5,6,7-tetrachlorophthalide (or the tautomer of the corresponding keto acid) are added with stirring, the mixture is heated to 100° C. and maintained at this temperature for 3 hours. It is cooled to 50° C., 25 ml of methyl ethyl ketone and 10 ml of petroleum ether are added, and the product is allowed to complete crystallization at 20° C. for 2 hours. It is filtered off and dried to give 2.9 g of the compound of the formula

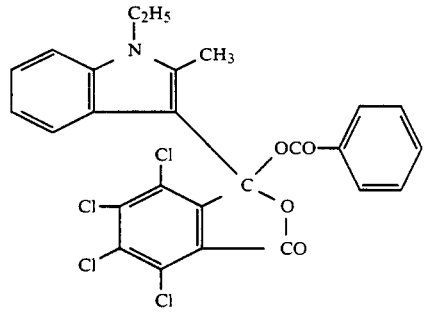

(21)

which, after recrystallization from methyl ethyl ketone, precipitates in pure form and has a melting point of 129°-131° C.

EXAMPLE 1

Dispersion A is prepared by milling 2.43 g of 3-(1'-ethyl-2'-methylindol-3'-yl)-3-acetoxy-4,5,6,7-tetrachlorophthalide of the formula (11) with 15.8 g of a 5% by weight, aqueous solution of polyvinyl alcohol (Polyviol VO3/140) together with glass beads up to a particle size of 2-4 μm.

To prepare a dispersion B, 2.78 g of dithiocyanatodi-(2,3-dimethyl-1-phenyl-3-pyrazolin-5-one)zinc (II) (antipyrine complex of zinc thiocyanate) are milled with 18.1 g of a 5% by weight aqueous solution of polyvinyl alcohol (polyviol V03/140) together with glass beads up to a particle size of 2-4 μm.

Dispersions A and B are mixed and applied to paper having a weight per unit area of 50 g/m$^2$ by means of a blade in such a manner that the applied material corresponds to a dry weight of 3-4 g/m$^2$. When the paper is brought into contact with a hot plate, a magenta-coloured thermoprint develops from 150° C. onwards.

The 3-(1'-ethyl-2'-methylindol-3'-yl)-3-acetoxy-4,5,6,7-tetrachlorophthalide is prepared according to Procedure A.

EXAMPLE 2

The procedure as described in Example 1 is repeated, replacing the phthalide compound of the formula (11) in dispersion A with an equimolar amount of the phthalide compound of the formula (14) according to Procedure D, to give a magenta-coloured print.

EXAMPLE 3

The procedure as described in Example 1 is repeated, replacing the phthalide compound of the formula (11) in dispersion A with an equimolar amount of the phthalide compound of the formula (12) according to Procedure B, to give a magenta-coloured print.

EXAMPLE 4

The procedure as described in Example 1 is repeated, replacing the phthalide compound of the formula (11) in dispersion A with an equimolar amount of the phthalide compound of the formula (18) according to Procedure H, to give a magenta-coloured print.

EXAMPLE 5

The procedure as described in Example 1 is repeated, replacing the phthalide compound of the formula (11) in dispersion A with an equimolar amount of the phthalide compound of the formula (21) according to Procedure L, to give a magenta-coloured print.

EXAMPLE 6

The procedure as described in Example 1 is repeated, replacing the phthalide compound of the formula (11) in dispersion A with an equimolar amount of the phthalide compound of the formula (15) according to Procedure E, to give a blue thermoprint.

EXAMPLE 7

Dispersion A is prepared by milling 2.43 g of 3-(1'-ethyl-2'-methylindol-3'-yl)-3-acetoxy-4,5,6,7-tetrachlorophthalide of the formula (11) with 15.8 g of a 5% by weight, aqueous solution of polyvinyl alcohol (Polyviol VO3/140) together with glass beads up to a particle size of 2–4 μm.

To prepare a dispersion B, 2.28 g of dithiocyanatodi-(3-amino-4-methoxytoluene)zinc (II) (p-cresidine complex of zinc thiocyanate) are milled with 14.8 g of a 5% by weight aqueous solution of polyvinyl alcohol (polyviol VO3/140) together with glass beads up to a particle size of 2–4 μm.

Dispersions A and B are mixed and applied to paper having a weight per unit area of 50 g/m$^2$ by means of a blade in such a manner that the applied material corresponds to a dry weight of 3–4 g/m$^2$. When the paper is brought into contact with a hot plate, an ochre-coloured thermoprint develops from 150° C. onwards.

The p-cresidine complex of zinc thiocyanate used in Example 7 is prepared as follows:

3.6 g of zinc sulfate$\times 7H_2O$ and 7.4 g of potassium thiocyanate are dissolved together in 150 ml of water at room temperature. A solution of 3.0 g of 3-amino-4-methoxytoluene in 50 ml of ethanol is then added dropwise to give a white precipitate which is filtered off, washed with water and dried at 60° C. The product obtained has a melting point of 135°–136° C.

EXAMPLE 8

Dispersion A is prepared by milling 2.85 g of 3-(1'-n-octyl-2'-methylindol-3'-yl)-3-acetoxy-4,5,6,7-tetrachlorophthalide of the formula (13) with 18.5 g of a 5% by weight, aqueous solution of polyvinyl alcohol (Polyviol VO3/140) together with glass beads up to a particle size of 2–4 μm.

To prepare a dispersion B, 2.78 g of dithiocyanatodi-(2,3-dimethyl-1-phenyl-3-pyrazolin-5-one)zinc (II) (antipyrine complex of zinc thiocyanate) are milled with 18.1 g of a 5% by weight aqueous solution of polyvinyl alcohol (polyviol VO3/140) together with glass beads up to a particle size of 2–4 μm.

Dispersions A and B are mixed and applied to paper having a weight per unit area of 50 g/m$^2$ by means of a blade in such a manner that the applied material corresponds to a dry weight of 3–4 g/m$^2$. When the paper is brought into contact with a hot plate, a violet thermoprint develops from 150° C. onwards.

EXAMPLE 9

Dispersion A is prepared by milling 2.85 g of 3-(1'-n-octyl-2'-methylindol-3'-yl)-3-acetoxy-4,5,6,7-tetrachlorophthalide of the formula (13) with 18.5 g of a 5% by weight, aqueous solution of polyvinyl alcohol (Polyviol VO3/140) together with glass beads up to a particle size of 2–4 μm.

To prepare a dispersion B, 2.28 g of dithiocyanatodi-(3-amino-4-methoxytoluene)zinc (II) (p-cresidine complex of zinc thiocyanate) are milled with 18.1 g of a 5% by weight aqueous solution of polyvinyl alcohol (polyviol VO3/140) together with glass beads up to a particle size of 2–4 μm.

Dispersions A and B are mixed and applied to paper having a weight per unit area of 50 g/m$^2$ by means of a blade in such a manner that the applied material corresponds to a dry weight of 3–4 g/m$^2$. When the paper is brought into contact with a hot plate, an ochre-coloured thermoprint develops from 150° C. onwards.

EXAMPLE 10

Dispersion A is prepared by milling 50 g of 3-(1'-ethyl-2'-methylindol-3'-yl)-3-acetoxy-4,5,6,7-tetrachlorophthalide of the formula (11) with 150 g of a 10% by weight, aqueous solution of polyvinyl alcohol (Polyviol VO3/140) together with 500 g of glass beads up to a particle size of 2–4 μm.

To prepare a dispersion B, 50 g of dithiocyanatodi-(2,3-dimethyl-1-phenyl-3-pyrazolin-5-one)zinc (II) (antipyrine complex of zinc thiocyanate) are milled with 150 g of a 10% by weight aqueous solution of polyvinyl alcohol (polyviol VO3/140) up to a particle size of 2–4 μm.

2 g of dispersion A and 2.5 g of dispersion B are made into a brushing paste and applied to a paper having a weight per unit area of 50 g/m$^2$ by means of a blade in such a manner that the applied brushing mixture corresponds to a dry weight of 1.15 g/m$^2$. When the paper is used in a facsimile machine (Infotec 6500), a magenta-coloured thermoprint develops.

EXAMPLE 11

Dispersion A is prepared by milling 50 g of 3-(1'-ethyl-2'-methylindol-3'-yl)-3-acetoxy-4,5,6,7-tetrachlorophthalide of the formula (11) with 150 g of a 10% by weight, aqueous solution of polyvinyl alcohol (Polyviol VO3/140) together with 500 g of glass beads up to a particle size of 2–4 μm.

To prepare a dispersion B, 50 g of dithiocyanatodi-(2,3-dimethyl-1-phenyl-3-pyrazolin-5-one)zinc (II) (antipyrine complex of zinc thiocyanate) are milled with 150 g of a 10% by weight aqueous solution of polyvinyl alcohol (polyviol VO3/140) up to a particle size of 2–4 μm.

A dispersion C is prepared by milling 25 g of dibenzyl therephthalate and 75 g of a 10% by weight aqueous solution of starch with glass beads up to a particle size of 2–4 μm.

2 g of dispersion A and 2.5 g of dispersion B and 2 g of dispersion C are made into a brushing paste and applied to a paper having a weight per unit area of 50 $g/m^2$ by means of a blade in such a manner that the applied brushing mixture corresponds to a dry weight of 1.65 $g/m^2$.

When the paper is used in a facsimile machine (Infotec 6500), a magenta colour develops.

What is claimed is:

1. A heat-sensitive recording material comprising a support having a color reactant system which comprises (A) a polycyclic compound of the formula

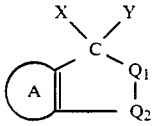

(1)

in which

X is a monocyclic or polycyclic aromatic or heteroaromatic radical,

Y is a substituent detachable as an anion, $Q_1$ is —O—, —S—, >N—R or >N—NH—R, $Q_2$ is $—CH_2—$, —CO—, —CS— or $—SO_2—$ and R is hydrogen, $C_1$–$C_{12}$alkyl, $C_5$–$C_{10}$cycloalkyl, aryl or aralkyl, and ring A is an aromatic or heterocyclic radical having 6 ring atoms, which can have an aromatic fused ring, it being possible for both ring A and the fused ring to be substituted, and (B) an organic condensable complex compound of a zinc salt.

2. A material according to claim 1, wherein in formula (1) X is a pyrrolyl, thienyl, indolyl, carbazolyl, acridinyl, benzofuranyl, benzothienyl, naphthothienyl, phenothiazinyl, indolinyl, julolidinyl, kairolyl, dihydroquinolyl or tetrahydroquinolyl radical.

3. A material according to claim 1, wherein in formula (1) X is a pyrrolyl, indolyl, carbazolyl, indolinyl, julolidinyl, kairolinyl, dihydroquinolinyl or tetrahydroquinolinyl radical.

4. A material according to claim 1, wherein in formula (1) X is a substituted 2-pyrrolyl, 3-pyrrolyl or 3-indolyl radical.

5. A material according to claim 1, wherein in formula (1) X is a phenyl or naphthyl radical which is unsubstituted or substituted by halogen, cyano, lower alkyl, $C_5$–$C_6$cycloalkyl, acyl, $—NR_1R_2$, $—OR_3$ or $—SR_3$, in which $R_1$, $R_2$ and $R_3$, independently of one another, are each hydrogen, unsubstituted or halogen-, hydroxyl-, cyano- or lower alkoxy-substituted alkyl having a maximum number of 12 carbon atoms, acyl having 1 to 8 carbon atoms, cycloalkyl having 5 to 10 carbon atoms or phenylalkyl or phenyl which is unsubstituted or ring-substituted by halogen, cyano, lower alkyl, lower alkoxy, lower alkoxycarbonyl, —NX'X'' or 4—NX'X''-phenylamino, in which X' and X'', independently of one another, are hydrogen, lower alkyl, cyclohexyl, benzyl or phenyl, or $R_1$ and $R_2$ together with the nitrogen atom linking them form a five- or six-membered heterocyclic radical.

6. A material according to claim 5, wherein in formula (1) X is a substituted phenyl radical of the formula

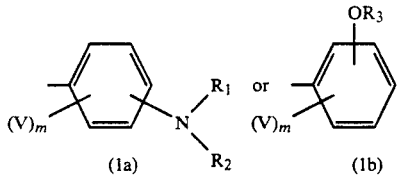

(1a) (1b)

in which $R_1$, $R_2$ and $R_3$, independently of one another, are each hydrogen, unsubstituted or halogen-, hydroxyl-, cyano- or lower alkoxy-substituted alkyl having a maximum number of 12 carbon atoms, acyl having 1 to 8 carbon atoms, cycloalkyl having 5 to 10 carbon atoms or phenylalkyl or phenyl which is unsubstituted or ring-substituted by halogen, trifluoromethyl, cyano, lower alkyl, lower alkoxy, lower alkoxycarbonyl, —NX'X'' or 4—NX'X''-phenylamino, in which X' and X'', independently of one another, are hydrogen, lower alkyl, cyclohexyl, benzyl or phenyl, or $R_1$ and $R_2$ together with the nitrogen atom linking them form a five- or six-membered heterocyclic radical and V is hydrogen, halogen, lower alkyl, $C_1$–$C_{12}$alkoxy, $C_1$–$C_{12}$acyloxy, benzyl, phenyl, benzyloxy, phenyloxy, halogen-, cyano-, lower alkyl- or lower alkoxy-substituted benzyl or benzyloxy, or is the group $—NT_1T_2$, $T_1$ and $T_2$, independently of one another, are each hydrogen, lower alkyl, $C_5$–$C_{10}$cycloalkyl, unsubstituted or halogen-, cyano-, lower alkyl- or lower alkoxy-substituted benzyl, or acyl having 1 to 8 carbon atoms and $T_1$ is also unsubstituted or halogen-, cyano-, lower alkyl- or lower alkoxy-substituted phenyl and m is 1 or 2.

7. A material according to claim 1, wherein in formula (1) Y is halogen, an aliphatic, cycloaliphatic, araliphatic, aromatic or heterocyclic ether group or an acyloxy group.

8. A material according to claim 1, wherein in formula (1) Y is an acyloxy group of the formula $$R'(NH—)_{n-1}—Q'—O— \quad (1c)$$

in which R' is unsubstituted or substituted $C_1$–$C_{22}$alkyl, cycloalkyl, aryl, aralkyl or heteroaryl, Q' is —CO— or $—SO_2—$ and n is 1 or 2.

9. A material according to claim 1, wherein in formula (1) Y is an acyloxy group of the formula R''—CO—O— in which R'' is lower alkyl or phenyl.

10. A material according to claim 1, wherein in formula (1) $Q_1$ is oxygen and $Q_2$ is —CO—.

11. A material according to claim 1, wherein in formula (1) ring A is a substituted or unsubstituted benzene, naphthalene, pyridine, pyrazine, quinoxaline or quinoline ring.

12. A material according to claim 1, wherein in formula (1) ring A is an unsubstituted or halogen-substituted benzene ring.

13. A material according to claim 1, wherein component (A) is a lactone compound of the formula

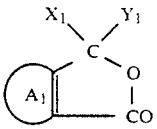

(2)

in which $A_1$ is a benzene or pyridine ring which is unsubstituted or substituted by halogen, cyano, lower alkyl, lower alkoxy or di(lower)alkylamino, $Y_1$ is halogen or acyloxy and $X_1$ is a 3-indolyl radical of the formula

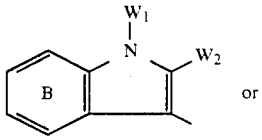

(2a)

a substituted phenyl radical of the formula

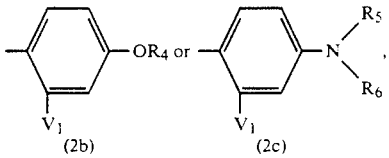

(2b) (2c)

in which $W_1$ is hydrogen, unsubstituted or cyano- or lower alkoxy-substituted $C_1$–$C_8$alkyl, acetyl, propionyl or benzyl, $W_2$ is hydrogen, lower alkyl, or phenyl, $R_4$, $R_5$ and $R_6$, independently of one other, are each unsubstituted or hydroxy-, cyano- or lower alkoxy-substituted alkyl having a maximum number of 12 carbon atoms, $C_5$–$C_6$cycloalkyl, benzyl, phenethyl or phenyl, or ($R_5$ and $R_6$) together with the nitrogen atom linking them are pyrrolidino, piperidino or morpholino, $V_1$ is hydrogen, halogen, lower alkyl, $C_1$–$C_8$alkoxy, benzyloxy or the group —$NT_3T_4$, $T_3$ and $T_4$, independently of one another, are each hydrogen, lower alkyl, lower alkylcarbonyl or unsubstituted or halogen-, methyl-or methoxy-substituted benzoyl, and ring B is unsubstituted or substituted by halogen, lower alkyl or di(-lower)alkylamino.

14. A material according to claim 13, wherein in formula (2) $Y_1$ is lower alkylcarbonyloxy or benzoyloxy.

15. A material according to claim 13, wherein in formula (2) $X_1$ is a 3-indolyl radical of the formula 2(a) in which $W_1$ is $C_1$–$C_8$alkyl and $W_2$ is methyl or phenyl, and $Y_1$ is lower alkylcarbonyloxy.

16. A material according to claim 1, wherein component (A) is a lactone compound of the formula

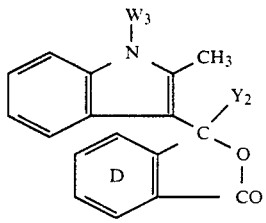

(3)

in which ring D is unsubstituted or chlorine-tetrasubstituted, $Y_2$ is acetoxy or benzoyloxy and $W_3$ is $C_1$–$C_8$alkyl.

17. A material according to claim 1, wherein component (A) is a lactone compound of the formula

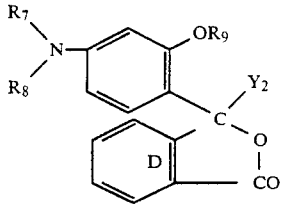

(4)

in which ring D is unsubstituted or chlorine-tetrasubstituted, $Y_2$ is acetoxy or benzoyloxy and $R_7$, $R_8$ and $R_9$ are each lower alkyl.

18. A material according to claim 1, wherein component (B) is a zinc thiocyanate complex compound of the formula

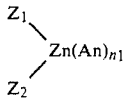

(5)

in which An is the anion of an inorganic acid, $n_1$ is 1 or 2 and $Z_1$ and $Z_2$, independently of one another, are each a colourless organic ligand which is bound to zinc via heteroatoms in the form of a complex.

19. A material according to claim 18, wherein in formula (5), $Z_1$ and $Z_2$ are each a unidentate ligand which is bound to zinc via nitrogen atoms in the form of a complex.

20. A material according to claim 18, wherein in formula (5) $Z_1$ and $Z_2$ are each a five- or six-membered nitrogen heterocycle which is bound to zinc via the nitrogen atom in the form of a complex and is unsubstituted or substituted by cyano, hydroxyl, $C_1$–$C_{18}$alkyl, $C_1$–$C_4$alkoxy, vinyl, phenyl, $C_1$–$C_4$acyl or amino groups or fused onto substituted or unsubstituted benzene rings.

21. A material according to claim 18, wherein in formula (5) An is a thiocyanate ion and $n_1$ is 2.

22. A material according to claim 1, wherein component (B) is a zinc thiocyanate complex compound of the formula

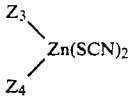

(6)

in which $Z_3$ and $Z_4$, independently of one another, are each a mono-coordinate five- or six-membered nitrogen heterocycle which is bound to zinc via the nitrogen atom in the form of a complex and is unsubstituted or mono- or polysubstituted by cyano, vinyl, formyl, phenyl, $C_1$–$C_{18}$alkyl, methoxy or amino groups or has a fused-on benzene ring.

23. A material according to claim 22, wherein in formula (6), $Z_3$ and $Z_4$ are each a pyrazolone, pyrazolinone, aminopyridine, quinoline, benzothiazole, imidazole or benzimidazole ligand bound to the nitrogen in the form of a complex, in which ligand the nitrogen hetero ring is unsubstituted or mono- or polysubstituted by cyano, methyl, methoxy, vinyl, formyl, phenyl or amino.

24. A material according to claim 22, wherein in formula (6) $Z_3$ and $Z_4$ are each a 1-methylimidazole, 2-methylimidazole, 2-aminopyridine, antipyrine or benzothiazole ligand bound to a nitrogen.

25. A material according to claim 1, wherein component (B) is the antipyrine complex of zinc thiocyanate, the aminopyridine complex of zinc thiocyanate, the anisidine complex of zinc thiocyanate or the 2-methoxy-5-methylaniline complex of zinc thiocyanate.

26. A material according to claim 1, which has a substrate on which components (A) and (B) are present together with a binder.

27. A material according to claim 1, which additionally contains a component (C) a colour-developing electron-withdrawing component.

28. A material according to claim 27, wherein the colour-developing component (C) is a Lewis acid, an acid clay, a solid carboxylic acid or a compound having a phenolic hydroxyl group.

29. A material according to claim 1, wherein components (A) and (B) are present together with one or more conventional colour formers.

30. A material according to claim 29, wherein the conventional colour formers present are 2,2-bis(aminophenyl)phthalides, 3-indolyl-3-aminophenylaza-or -diazaphthalides, 3,3-bis(indolyl)phthalides, 3-aminofluorans, 6-dialkylamino-2-dibenzylaminofluorans, 6-dialkylamino-3-methyl-2-arylaminofluorans, 3,6-bisalkoxyfluorans, 3,6-bis(diarylamino)fluorans, leukoauramines, spiropyrans, spirodipyrans, chromenopyrazoles, chromenoindoles, benzoxazines, phenoxazines, phenothiazines, quinazolines, rhodamine lactams, carbazolylmethanes or triarylmethane leuko dyes.

31. A material according to claim 1 which additionally contains an activator.

32. A material according to claim 31, wherein the activator is benzyldiphenyl, benzyloxynaphthalene, benzenesulfanilide, dibenzyl terephthalate or dimethyl terephthalate.

33. A material according to claim 1, on which components (A) and (B) are present together with a wax.

* * * * *